US009982847B2

(12) United States Patent
Van De Ven et al.

(10) Patent No.: US 9,982,847 B2
(45) Date of Patent: May 29, 2018

(54) LIGHTING DEVICE HAVING HEAT DISSIPATION ELEMENT

(75) Inventors: Antony Paul Van De Ven, Sai Kung (HK); Thomas G. Coleman, Pittsboro, NC (US); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 53 days.

(21) Appl. No.: 13/425,689

(22) Filed: Mar. 21, 2012

(65) Prior Publication Data

US 2012/0287629 A1 Nov. 15, 2012

Related U.S. Application Data

(63) Continuation of application No. PCT/US2010/049560, filed on Sep. 21, 2010.
(Continued)

(51) Int. Cl.
*F21V 29/00* (2015.01)
*F21K 99/00* (2016.01)
(Continued)

(52) U.S. Cl.
CPC ..... *F21K 9/135* (2013.01); *F21K 9/00* (2013.01); *F21K 9/232* (2016.08); *F21K 9/233* (2016.08);
(Continued)

(58) Field of Classification Search
CPC ..... C04B 2235/3826; C04B 2237/365; C04B 37/005; C04B 2235/5244; C04B 41/5059; C04B 14/324
(Continued)

(56) References Cited

U.S. PATENT DOCUMENTS 4,649,990 A 3/1987 Kurihara et al.
6,110,577 A 8/2000 Ishikawa et al.
(Continued)

FOREIGN PATENT DOCUMENTS

EP 2 085 683 8/2009
EP 2 146 135 1/2010
(Continued)

OTHER PUBLICATIONS

CoorsTek, "*Advanced Silicon Carbide for Critical Components*", 2005, pp. 1-2.
(Continued)

*Primary Examiner* — Tsion Tumebo
(74) *Attorney, Agent, or Firm* — Burr & Brown, PLLC

(57) ABSTRACT

A lighting device comprising at least a first light source and at least a first heat dissipation element. At least a first region of the dissipation element comprises at least one material selected from among (1) sintered silicon carbide, (2) a sintered mixture of silicon carbide and at least one other ceramic material, (3) a sintered mixture of silicon carbide and at least one metal other than aluminum, (4) a sintered mixture of silicon carbide, at least one other ceramic material and at least one metal other than aluminum and (5) a sintered mixture of silicon carbide, at least one other ceramic material and at least one metal. Also, a lighting device comprising at least a first light source and heat conducting means for dissipating heat.

22 Claims, 5 Drawing Sheets

Related U.S. Application Data

(60) Provisional application No. 61/245,683, filed on Sep. 25, 2009.

(51) Int. Cl.

| | |
|---|---|
| ***F21V 29/85*** | (2015.01) |
| ***F21K 9/00*** | (2016.01) |
| ***F21V 29/74*** | (2015.01) |
| ***F21K 9/232*** | (2016.01) |
| ***F21K 9/233*** | (2016.01) |
| *F21V 7/00* | (2006.01) |
| *F21Y 115/10* | (2016.01) |

(52) U.S. Cl.
CPC ..... *F21V 29/004* (2013.01); *F21V 29/74* (2015.01); *F21V 29/85* (2015.01); *F21V 29/86* (2015.01); *F21V 7/0008* (2013.01); *F21Y 2115/10* (2016.08)

(58) Field of Classification Search
USPC ..... 362/249.02, 235, 294, 373, 218
See application file for complete search history.

(56) References Cited

U.S. PATENT DOCUMENTS

| | | | | |
|---|---|---|---|---|
| 6,465,961 | B1 | 10/2002 | Cao | |
| 6,786,620 | B1 * | 9/2004 | Takezawa | 362/345 |
| 6,953,760 | B2 | 10/2005 | Pujari et al. | |
| 7,001,047 | B2 * | 2/2006 | Holder et al. | 362/249.04 |
| 7,084,496 | B2 | 8/2006 | Benner et al. | |
| 7,131,760 | B2 * | 11/2006 | Mayer et al. | 362/555 |
| 7,399,919 | B2 | 7/2008 | McCutcheon et al. | |
| 8,008,845 | B2 | 8/2011 | Van de Ven et al. | |
| 2002/0160902 | A1 * | 10/2002 | Lesniak et al. | 501/90 |
| 2005/0184387 | A1 * | 8/2005 | Collins et al. | 257/712 |
| 2005/0194690 | A1 * | 9/2005 | Ishii et al. | 257/772 |
| 2006/0076672 | A1 | 4/2006 | Petroski | |
| 2006/0118808 | A1 * | 6/2006 | Ishidu et al. | 257/100 |
| 2007/0139949 | A1 * | 6/2007 | Tanda et al. | 362/551 |
| 2007/0189017 | A1 | 8/2007 | Hofmann | |
| 2007/0230188 | A1 | 10/2007 | Lin | |
| 2007/0263384 | A1 | 11/2007 | Hsieh et al. | |
| 2008/0007953 | A1 | 1/2008 | Keller et al. | |
| 2008/0251809 | A1 | 10/2008 | Wolf et al. | |
| 2008/0258130 | A1 * | 10/2008 | Bergmann et al. | 257/13 |
| 2008/0296584 | A1 | 12/2008 | Hachigo | |
| 2009/0159905 | A1 | 6/2009 | Chen | |
| 2010/0007267 | A1 * | 1/2010 | Imai et al. | 313/503 |
| 2010/0067224 | A1 * | 3/2010 | Wu | 362/235 |

FOREIGN PATENT DOCUMENTS

| | | |
|---|---|---|
| JP | 57-210648 | 12/1982 |
| WO | 2006/135502 | 12/2006 |

OTHER PUBLICATIONS

CoorsTek, "*Pure SIC™ CVD Silicon Carbide*", 2005, pp. 1-4.
CoorsTek, "*ULTRASIC™ Direct Sintered and PURESIC™ CVD Silicon Carbide for Optical Applications*", 2005, pp. 1-2.
Datta et al., "*Sintering of nano crystalline a silicon carbide by doping with boron carbide*", Bull. Mater. Sci., vol. 25, No. E, Jun. 2002, pp. 181-189.
Pope et al., "*Sintered Diamond: Its Possible Use as a High Thermal Conductivity Semiconduction Device Substrate*", 1975, pp. 1-5.
Williams et al., "*Overview of the production of sintered SiC optics and optical sub-assemblies*", SPIE Optics and Photonics 2005, pp. 1-10.

* cited by examiner

LIGHTING DEVICE HAVING HEAT DISSIPATION ELEMENT

CROSS-REFERENCE TO RELATED APPLICATIONS

This application is a Continuation Application of International Application No. PCT/US10/49560 having an international filing date of Sep. 21, 2010, published in English on Mar. 31, 2011, which claims the benefit of U.S. Patent Application No. 61/245,683, filed Sep. 25, 2009, the entirety of which is incorporated herein by reference as if set forth in its entirety.

FIELD OF THE INVENTIVE SUBJECT MATTER

The present inventive subject matter relates to a lighting device that has at least one heat dissipation element and/or at least one heat dissipation means. In some embodiments, the present inventive subject matter relates to a lighting device that includes one or more solid state light emitting devices, e.g., one or more light emitting diodes.

BACKGROUND

There are a wide variety of light sources in existence, e.g., incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc. The various types of light sources have been provided in a variety of shapes, sizes and arrangements, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. The various types of light sources have been supplied with energy in various ways, e.g., with an Edison connector, a battery connection, a GU-24 connector, direct wiring to a branch circuit, etc. The various types of light sources have been designed so as to serve any of a variety of functions (e.g., as a flood light, as a spotlight, as a downlight, etc.), and have been used in residential, commercial or other applications.

With many light sources, there is a desire to effectively dissipate heat produced in generating light.

For example, with many incandescent light sources, about ninety percent of the electricity consumed is released as heat rather than light. There are many situations where effective heat dissipation is needed or desired for such incandescent light sources.

Solid state light emitters (e.g., light emitting diodes) are receiving much attention due to their energy efficiency. A challenge with solid state light emitters is that many solid state light emitters do not operate as well as possible when they are subjected to elevated temperatures. For example, many light emitting diode light sources have average operating lifetimes of decades (as opposed to just months or 1-2 years for many incandescent bulbs), but some light emitting diodes' lifetimes can be significantly shortened if they are operated at elevated temperatures. A common manufacturer recommendation is that the junction temperature of a light emitting diode should not exceed 70 degrees C. if a long lifetime is desired.

In addition, the intensity of light emitted from some solid state light emitters varies based on ambient temperature. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.). In many lighting devices that include solid state light emitters as light sources (e.g., general illumination devices that emit white light in which the light sources consist of light emitting diodes), a plurality of solid state light emitters are provided that emit light of different colors which, when mixed, are perceived as the desired color for the output light (e.g., white or near-white). The desire to maintain a relatively stable color of light output is therefore an important reason to try to reduce temperature variation of solid state light emitters.

In some cases (e.g., most residential applications), fixtures (e.g., "cans") are required to be substantially airtight around the sides and top to prevent the loss of ambient heat or cooling from the room into the ceiling cavity through the fixture. As the lamp is mounted in the can, much of the heat generated by the light source is trapped within the can, because the air heated in the can rises and is trapped within the can. Insulation is usually required around the can within the ceiling cavity to further reduce heat loss or cooling loss from the room into the ceiling cavity.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

Because light that is perceived as white is necessarily a blend of light of two or more colors (or wavelengths), no single light emitting diode junction has been developed that can produce white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

BRIEF SUMMARY OF THE INVENTIVE SUBJECT MATTER

In accordance with one aspect of the present inventive subject matter, there is provided a lighting device that comprises at least a first light source and at least a first heat dissipation element, at least a first region of the first heat dissipation element comprising at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide plus at least one other ceramic material and at least one metal other than aluminum Sintered silicon carbide (or any of the sintered mixtures that contain silicon carbide, as mentioned above) can be fabricated and machined into a desired shape. Such sintered materials can provide excellent structural support for a lighting device, as well as excellent thermal conductivity.

The use of sintered silicon carbide (or any of the sintered mixtures that contain silicon carbide, as mentioned above) is particularly well suited for lighting devices that comprise one or more solid state light emitters, as such light emitters typically benefit from the use of structural parts that also conduct heat effectively (i.e., that have high thermal conductivity) in order to dissipate heat from the solid state light emitters (e.g., light emitting diodes) so as to maintain junction temperatures within acceptable ranges. Such properties are especially valuable with respect to devices in which the surface area from which heat can be dissipated is limited. In addition, by providing lighting devices in which at least a portion of a heat dissipation element comprises transparent or substantially transparent sintered SiC (or other sintered mixtures that contain silicon carbide, as described herein), if the heat dissipation element is in the path of at least some of the light emitted by the one or more light source, the heat dissipation element can allow for more light to exit the lighting device (i.e., less light is absorbed or reflected by the heat dissipation element) than would otherwise be the case if the entirety of the heat dissipation element were opaque, while the heat dissipation element is still capable of conducting a desired amount of heat away from the light source(s).

In the case of light sources that comprise one or more solid state light emitters, sintered silicon carbide (and the sintered mixtures that contain silicon carbide, as mentioned above) can have a thermal expansion coefficient that is closely matched to that of silicon carbide-based semiconductor devices. Accordingly, in such light sources, the rate of incidence of failures that might otherwise result from differing rates of thermal expansion can be reduced or avoided.

In accordance with another aspect of the present inventive subject matter, there is provided a lighting device comprising at least a first light source and means for dissipating heat.

In some embodiments according to the present inventive subject matter, including some embodiments that include or do not include any of the features as discussed herein, the first light source comprises at least one solid state light emitter.

In some embodiments according to the present inventive subject matter, including some embodiments that include or do not include any of the features as discussed herein, at least a second region of the first heat dissipation element comprises at least one material selected from among diamond, glass, polymer and ceramic.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
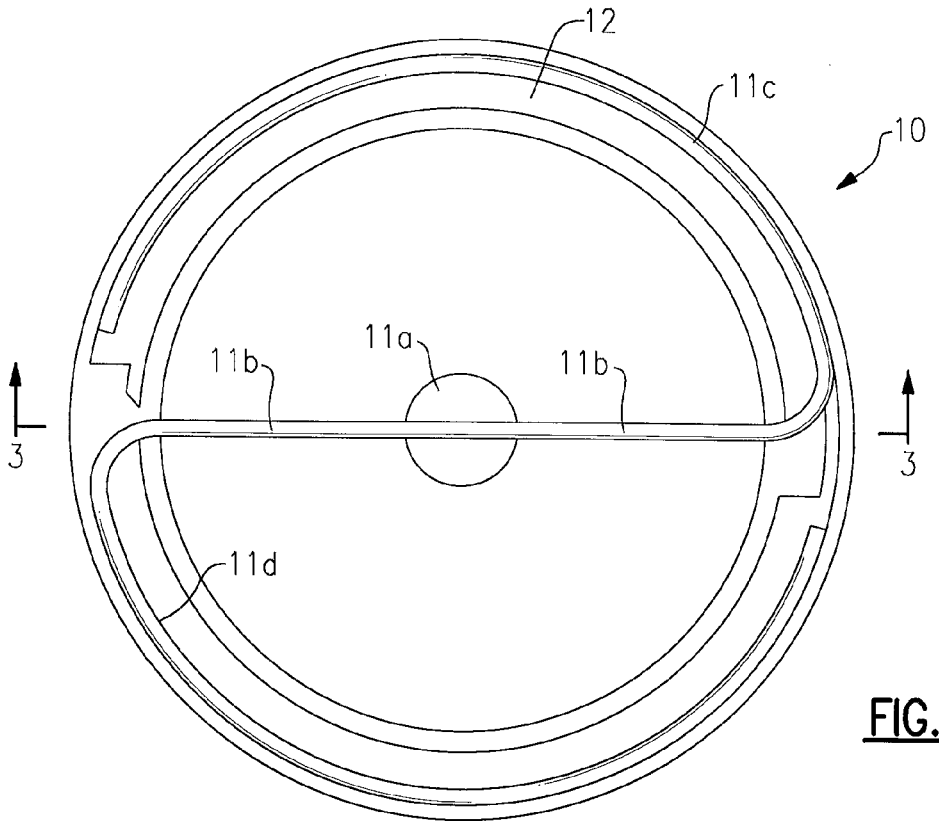
FIG. 1 is a top view of a lighting device 10.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items. All numerical quantities described herein are approximate and should not be deemed to be exact unless so stated.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The term "illumination" (or "illuminated"), as used herein means that a light source is emitting electromagnetic radiation. For example, when referring to a solid state light emitter, the term "illumination" means that at least some current is being supplied to the solid state light emitter to cause the solid state light emitter to emit at least some electromagnetic radiation (in some cases, with at least a portion of the emitted radiation having a wavelength between 100 nm and 1000 nm, and in some cases within the visible spectrum). The expression "illuminated" also encompasses situations where the light source emits light continuously or intermittently at a rate such that if it is or was visible light, a human eye would perceive it as emitting light continuously (or discontinuously), or where a plurality of light sources (especially in the case of solid state light emitters) that emit light of the same color or different colors are emitting light intermittently and/or alternatingly (with or without overlap in "on" times) in such a way that if they were or are visible light, a human eye would perceive them as emitting light continuously or discontinuously (and, in cases where different colors are emitted, as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "substantially transparent", as used herein, means that the structure that is characterized as being substantially transparent allows passage of at least 90% of incident visible light.

The expression "partially transparent", as used herein, means that the structure that is characterized as being partially transparent allows passage of at least some incident visible light.

The expression "substantially all", as used herein, means at least 90%, in some instances at least 95%, in some instances at least 99%, and in some instances at least 99.9%.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one light source in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

According to an aspect of the present inventive subject matter, there is provided a heat dissipation element.

According to an aspect of the present inventive subject matter, there is provided a lighting device comprising at least a first heat dissipation element.

According to an aspect of the present inventive subject matter, there is provided a lighting device comprising at least one light source and at least a first heat dissipation element.

Each of the one or more light sources can be selected from among any or all of the wide variety of light sources known to persons of skill in the art. Representative examples of types of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., each with or without one or more filters. That is, the at least one light source can comprise a single light source, a plurality of light sources of a particular type, or any combination of one or more light sources of each of a plurality of types.

A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

A luminescent material is a material that emits a responsive radiation (e.g., visible light) when excited by a source of exciting radiation. In many instances, the responsive radiation has a wavelength which is different from the wavelength of the exciting radiation.

Luminescent materials can be categorized as being down-converting, i.e., a material which converts photons to a lower energy level (longer wavelength) or up-converting, i.e., a material which converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks which glow in the visible spectrum upon illumination with ultraviolet light.

The advantage of providing a wider spectrum of visible wavelengths to provide increased CRI (e.g., Ra) is well known, and the ability to predict the perceived color of output light from a lighting device which includes light emitters which output two or more respective colors of light is also well known, e.g., with the assistance of the CIE color charts.

Luminescent material (when included) can be provided in any desired form. For example, the luminescent element can be embedded in the heat dissipation element and/or in a resin (i.e., a polymeric matrix), such as a silicone material, an epoxy material, a glass material or a metal oxide material. The luminescent material can be contained in an encapsulant in which one or more light source (e.g., a light emitting diode) is embedded.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009-0108269), the entirety of which is hereby incorporated by reference as if set forth in its entirety.

Each of the one or more light sources can be of any suitable shape, a variety of which are known to those of skill in the art, e.g., in the shape of an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp. Lighting devices according to the present inventive subject matter can comprise one or more light sources of a particular shape or one or more light sources of each of a plurality of different shapes.

Each of the one or more light sources can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

Each lighting device according to the present inventive subject matter comprises one or more heat dissipation elements. At least a first heat dissipation element in the lighting device has one or more regions that comprise at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide plus at least one other ceramic material and at least one metal other than aluminum.

Persons of skill in the art have ready access to sources of silicon carbide. The expression "sintered silicon carbide", as used herein, does not encompass sintered aluminum silicon carbide (i.e., sintered AlSiC), i.e., "sintered silicon carbide" is substantially free of aluminum.

The at least one other ceramic material, when employed, can be any suitable ceramic material, a wide variety of ceramic materials being well known and readily obtainable. Representative examples of ceramic materials which can be employed, if desired, include $Al_2O$, silicides, borides, nitrides, silica, magnesia, zirconia, beryllia, carbides, glass, etc The expression "sintered mixture of silicon carbide and at least one other ceramic material", as used herein, does not encompass any sintered mixtures that comprise aluminum (i.e., sintered AlSiC), i.e., "sintered mixture of silicon carbide and at least one other ceramic material" is substantially free of aluminum.

The at least one metal, when employed, can be any suitable metal (aluminum is excluded from the group of metals that can be employed in accordance with the present inventive subject matter), e.g., magnesium, copper, tin, titanium, zinc and lead. The expression "sintered mixture of silicon carbide and at least one metal other than aluminum", as used herein, does not encompass any sintered mixtures that comprise aluminum (i.e., sintered AlSiC), i.e., "sintered mixture of silicon carbide and at least one metal other than aluminum" is substantially free of aluminum.

The expression "sintered silicon carbide", as used herein, means a structure obtained by sintering silicon carbide (alone or with other materials other than aluminum).

The expression "sintered mixture of silicon carbide and at least one other ceramic material", as used herein means a structure obtained by sintering a mixture comprising silicon carbide and at least one other ceramic material (which could for example be a structure obtained by sintering a mixture consisting essentially of silicon carbide and at least one other ceramic material, and excluding aluminum).

The expression "sintered mixture of silicon carbide and at least one metal other than aluminum", as used herein means a structure obtained by sintering a mixture of silicon carbide and at least one metal other than aluminum (which could for example be a structure obtained by sintering a mixture consisting essentially of silicon carbide and at least one metal other than aluminum).

The expression "sintered mixture of silicon carbide, at least one other ceramic material and at least one metal other than aluminum", as used herein means a structure obtained by sintering a mixture comprising silicon carbide, at least one other ceramic material and at least one metal other than aluminum (which could for example be a structure obtained by sintering a mixture consisting essentially of silicon carbide, at least one other ceramic material and at least one metal other than aluminum).

The expression "sintered mixture of silicon carbide, at least one other ceramic material and at least one metal", as used herein means a structure obtained by sintering a mixture comprising silicon carbide, at least one other ceramic material and at least one metal (which could for example be a structure obtained by sintering a mixture consisting essentially of silicon carbide, at least one other ceramic material and at least one metal, which could comprise aluminum).

The expression "sintered mixture of silicon carbide, at least one other ceramic material and at least one metal other than aluminum", as used herein, does not encompass any sintered mixtures that comprise aluminum (i.e., sintered AlSiC), i.e., "sintered mixture of silicon carbide, at least one other ceramic material and at least one metal other than aluminum" is substantially free of aluminum.

The term "sintering" is used in accordance with its normal usage as understood by persons skilled in the art to mean heating powdered material (and/or particulate material) to a temperature that is below the melting point of the powdered (or particulate) material but that is high enough that the particles adhere to each other and become a coherent mass.

The term "sintered" means that the material described as being sintered has been subjected to at least one sintering step.

Sintering can be carried out by any suitable method, e.g., a method as described in http://machinedesign.com/BDE/materials/bdemat7/bdemat7_2.html.

In some embodiments according to the present inventive subject matter, sintered silicon carbide is produced by a method corresponding to the following steps:

(1) Silicon carbide raw material can be produced by mixing high purity SiC with sintering aids and binder systems to aid in producing large-scale products from fine-grained material. Initially, the powder is ball milled to a precise sub-micron size distribution. When the target particle size has been reached, sintering aids, typically boron carbide and phenolic resin, can be introduced to the milling operation. The sintering aids enable the SiC to reach high density during sintering. These sintering aids typically comprise less than 1% by weight of the sintered material.

(2) A sealable container, e.g., a rubber bag, can be filled with the SiC powder. The rubber bag can be supported with a skeletal structure, e.g., a steel box, which has several perforations to allow an isostatic force media, such as water, to be applied to the full surface area of the bag. The bag of powder can be placed into a pressure vessel and be subjected to hydraulic pressure as high as 30 thousand pounds per square inch (30 KPSI).

(3) The resulting material can be subjected to green forming. Green forming, also known as green machining, is a process for near net shaping the unsintered SiC to its final design. In addition, features can be net shaped in the green state and relatively quick post-sinter machining operations can be used to finish the feature to specification.

(4) The green-formed structure can then be sintered. Sintering typically takes 20 to 120 hours, depending on size and complexity of the load. During this process, there are three basic stages; binder burnout up until 500 degrees C.; densification (shrinkage of approximately 20%) up to 2100 degrees C.; then cool-down. SiC powder is highly vulnerable to oxidation at temperatures over 1000 degrees C. To avoid oxidation, the SiC powder can be kept under vacuum or an inert atmosphere during the sintering process.

(5) The sintered structure can be machined using diamond grinding or lapping into the desired shape.

The precise parameters employed in performing sintering (e.g., particle sizes of powder, temperature regimen, sintering aids, pressure, etc.) can readily be selected based on starting materials and desired properties. Silicon carbide can be sintered without sintering aids at temperatures in the range of 1900 to 2300 degrees C. under pressures of from 100 to 400 MPa.

Sintered silicon carbide (and/or the sintered products of the other mixtures described herein) can provide heat dissipation elements that have high strength, high hardness, high stiffness, structural integrity, good polishability and good thermal stability.

The at least one heat dissipation element can be of any suitable shape and size, and persons of skill in the art can readily envision a wide variety of such shapes and sizes depending on the overall shape and size of the lighting device in which the heat dissipation element(s) are being employed, as well as the shape and size of individual components included in the lighting device. For example, in some embodiments according to the present inventive subject matter, including some embodiments that include or do not include any of the features as discussed herein, the heat dissipation element (or one or more of the heat dissipation elements) can be (or can comprise a portion that is) substantially cylindrical, substantially disc-shaped or substantially bulb-shaped.

The expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension.

The expression "substantially disc-shaped", as used herein, means a structure that is substantially cylindrical (as defined above), where the axial dimension of the structure is less than the radial dimension of the structure.

The expression "substantially bulb-shaped", as used herein, means a structure that includes at least a first portion that is substantially cylindrical and at least a second portion that extends diametrically in a direction perpendicular to an axis of the substantially cylindrical portion farther than the substantially cylindrical portion, including (but not limited to) shapes that correspond to A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, AR lamps, ED lamps, E lamps, BT lamps, A-line compact fluorescent lamps, globe screw base compact fluorescent lamps, reflector screw base compact fluorescent lamps, etc.

For example, in accordance with the present inventive subject matter, the heat dissipation element (or one or more of the heat dissipation elements) can have a shape and size that corresponds to a heat dissipation element in any other lighting device, such as:

a bridge on which one or more light sources are mounted, as described in U.S. patent application Ser. No. 12/469,819, filed on May 21, 2009 (now U.S. Patent Publication No. 2010-0102199), the entirety of which is hereby incorporated by reference as if set forth in its entirety, a bridge on which one or more light sources are mounted, as described in U.S. patent application Ser. No. 12/467,467, filed on May 18, 2009 (now U.S. Patent Publication No. 2010/0290222), the entirety of which is hereby incorporated by reference as if set forth in its entirety;

a bridge on which one or more light sources are mounted, as described in U.S. patent application Ser. No. 12/469,828, filed on May 21, 2009 (now U.S. Patent Publication No. 2010-0103678), the entirety of which is hereby incorporated by reference as if set forth in its entirety;

an "S" shaped heat pipe on which one or more light sources are mounted, as described in U.S. patent application Ser. No. 12/469,828, filed on May 21, 2009 (now U.S. Patent Publication No. 2010-0103678);

a lens that covers (partially or completely) an opening through which light is emitted, e.g., a back-reflector as described in U.S. patent application Ser. No. 12/469,828, filed on May 21, 2009 (now U.S. Patent Publication No. 2010-0103678).

In accordance with the present inventive subject matter, the heat dissipation element (or one or more of the heat dissipation elements) can have a shape and size that corresponds to the bulb portion (or a portion thereof) of any lighting device, such as: an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp.

In accordance with the present inventive subject matter, the heat dissipation element (or one or more of the heat dissipation elements) can constitute the bulb portion, or can constitute one or more parts of the bulb portion, of any lighting device, such as: an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp.

In some embodiments according to the present inventive subject matter, including some embodiments that include or do not include any of the features as discussed herein, at least a first cross-section of the first heat dissipation element (or one or more of the heat dissipation elements) is substantially annular. The expression "substantially annular", as used herein, means a structure that extends around an unfilled region, and which can otherwise be of any general shape, and any cross-sections can be of any shape. For example, "annular" encompasses ring-like shapes which can be defined by rotating a circle about an axis in the same plane as, but spaced from, the circle. "Annular" likewise encompasses shapes which can be defined by rotating a square (or any other two-dimensional shape) about an axis in the same plane as, but spaced from, the square. "Annular" likewise encompasses shapes that can be defined by moving any shape from a first position, through space along any path without ever moving to a position where part of the shape occupies a space previously occupied by any part of the shape, and eventually returning to the first position. "Annular" likewise encompasses shapes that can be defined by moving any shape from a first position, through space along any path without ever moving to a position where part of the shape occupies a space previously occupied by any part of the shape, and eventually returning to the first position, and where the shape and size of the shape being moved can be altered at any time, and any number of times, during its movement.

In some embodiments according to the present inventive subject matter, the heat dissipation element (or one or more of the heat dissipation elements) can comprise (a) a first material (which can have a moderate heat conductivity or a lower heat conductivity, such as glass) and (b) one or more region that comprises at least one material selected from among (1) sintered silicon carbide, (2) a sintered mixture of silicon carbide and at least one other ceramic material, (3) a sintered mixture of silicon carbide and at least one metal other than aluminum, (4) a sintered mixture of silicon carbide, at least one other ceramic material and at least one metal other than aluminum, and (5) a sintered mixture of silicon carbide, at least one other ceramic material and at least one metal. Any such heat dissipation element(s) can, if desired, further comprise one or more regions or structures of high heat conducting capability (e.g., one or more wires, bars, layers, particles, regions and/or slivers made of a material that is a good conductor of heat, e.g., having a heat conductivity of at least 1 W/m-K). In such embodiments, the heat dissipation element(s) and any other regions can be of any sub-shapes in relation to the overall shape of the structure in which they are contained, e.g., where the overall shape is of a disc, the sub-shapes can be vertical slices (like pie slices), horizontal slices (i.e., to form stacked discs), etc.

In some embodiments according to the present inventive subject matter, the heat dissipation element (or one or more of the heat dissipation elements) can comprise (a) one or more region that comprises at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and (b) one or more regions or structures of high heat conducting capability (e.g., one or more wires, bars, layers, particles, regions and/or slivers made of a material that is a good conductor of heat, e.g., having a heat conductivity of at least 1 W/m-K). In such embodiments, the heat dissipation element(s) and any other regions can be of any sub-shapes in relation to the overall shape of the structure in which they are contained, e.g., where the overall shape is of a disc, the sub-shapes can be vertical slices (like pie slices), horizontal slices (i.e., to form stacked discs), etc.

Some embodiments according to the present inventive subject matter can further comprise one or more heat spreader. A heat spreader typically has a heat conductivity that is higher than the heat conductivity of the substantially transparent heat sink. For example, in some embodiments of the present inventive subject matter, a heat spreader is provided in order for heat to be spread out into a larger surface area from which it can be dissipated through the substantially transparent heat sink and/or other structure. Representative examples of materials out of which a heat spreader (if provided) can be made include copper, aluminum, diamond and DLC. A heat spreader (if provided) can be of any suitable shape. Use of materials having higher heat conductivity in making heat spreaders generally provides greater heat transfer, and use of heat spreaders of larger surface area and/or cross-sectional area generally provides greater heat transfer, but might block the passage of more light. Representative examples of shapes in which the heat spreaders, if provided, can be formed include bars (e.g., diametrical or cantilevered across an aperture), crossbars, wires and/or wire patterns. Heat spreaders, if included, can also function as one or more electrical terminals for carrying electricity, if desired.

The heat dissipation element (or one or more of the heat dissipation elements) can consist of a single heat dissipation structure, or it can comprise a plurality of heat dissipation structures.

The heat dissipation element (or one or more of the heat dissipation elements) can be of a shape that refracts light, for example a shape that refracts light in many complicated ways. With any of the lighting devices according to the present inventive subject matter, particularly those that include one or more heat dissipation elements that refract light in complicated ways, persons of skill in the art are familiar with experimenting with and adjusting light refracting shapes so as to achieve desired light focusing, light directing, and/or light mixing properties, including mixing of light of differing hues.

The heat dissipation element (or one or more of the heat dissipation elements) can, if desired, include one or more optical features formed on its surface and/or within. As used herein, the expression "optical feature" refers to a three dimensional shape that has a contour that differs from the contour of the immediate surroundings, or to a pattern of shapes that has a contour that differs from the contour of the immediate surrounding. The size of such contour can be nano, micro, or macro in size or scale. A pattern of optical features can be any suitable pattern for providing a desired diffusion and/or mixing of light. The pattern can be repeating, pseudo-random or random. The expression "pseudo-random" means a pattern that includes one or more types of random sub-patterns which are repeated. The expression "random" means a pattern that does not include any substantial regions which are repeated. Persons of skill in the art are familiar with a wide variety of optical features as defined herein, and any such optical features can be employed in the lighting devices according to the present inventive subject matter.

In some embodiments according to the present inventive subject matter, including some embodiments that include or do not include any of the features as discussed herein, the first heat dissipation element (or one or more of the heat dissipation elements) comprises at least one opaque region. The term "opaque", as used herein, means that the structure (or region of a structure) that is characterized as being opaque allows passage of less than 90% of incident visible light.

In some embodiments according to the present inventive subject matter, including some embodiments that include or do not include any of the features as discussed herein, the first heat dissipation element (or one or more of the heat dissipation elements) comprises at least a first reflective region. The term "reflective", as used herein, means that the structure (or region of a structure) that is characterized as being reflective reflects at least 50% of incident visible light.

In some embodiments according to the present inventive subject matter, including some embodiments that include or do not include any of the features as discussed herein, at least a first region of the first heat dissipation element (or one or more of the heat dissipation elements) further comprises at least one material selected from among scattering agents and luminescent materials.

In some embodiments according to the present inventive subject matter, including some embodiments that include or do not include any of the features as discussed herein, the first light source is in contact with the first heat dissipation element (or one or more of the heat dissipation elements). The expression "in contact with", as used herein, means that the first structure that is in contact with a second structure is in direct contact with the second structure or is in indirect contact with the second structure. The expression "in indirect contact" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "in direct contact", as used in the present specification, means that the first structure which is "in direct contact" with a second structure is touching the second structure and there are no intervening structures between the first and second structures at least at some location.

The present inventive subject matter is also directed to a light fixture that comprises at least one lighting device as described herein. The light fixture can comprise a housing, a mounting structure, and/or an enclosing structure. Persons of skill in the art are familiar with, and can envision, a wide variety of materials out of which a fixture, a housing, a mounting structure and/or an enclosing structure can be constructed, and a wide variety of shapes for such a fixture, a housing, a mounting structure and/or an enclosing structure. A fixture, a housing, a mounting structure and/or an enclosing structure made of any of such materials and having any of such shapes can be employed in accordance with the present inventive subject matter.

For example, fixtures, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010-0102697), the entirety of which is hereby incorporated by reference as if set forth in its entirety;

U.S. patent application Ser. No. 12/469,819, filed on May 21, 2009 (now U.S. Patent Publication No. 2010-0102199), the entirety of which is hereby incorporated by reference as if set forth in its entirety; and U.S. patent application Ser. No. 12/469,828, filed on May 21, 2009 (now U.S. Patent Publication No. 2010-0103678), the entirety of which is hereby incorporated by reference as if set forth in its entirety.

Some embodiments in accordance with the present inventive subject matter include one or more lenses or diffusers. Persons of skill in the art are familiar with a wide variety of lenses and diffusers, and can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any desired location and orientation.

In embodiments in accordance with the present inventive subject matter that include a lens (or plural lenses), the lens (or lenses) can be positioned in any desired location and orientation.

In some embodiments according to the present inventive subject matter, including some embodiments that include or do not include any of the features as discussed above, the lighting device further comprises circuitry that delivers current from at least one energy source to the light source (or light sources).

In some lighting devices according to the present inventive subject matter, there are further included one or more circuitry components, e.g., drive electronics for supplying and controlling current passed through the light source (or sources) in the lighting device.

Persons of skill in the art are familiar with a wide variety of ways to supply and control the current passed through light sources, e.g., solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired. For example, circuitry that may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

The lighting devices according to the present inventive subject matter can further comprise any suitable electrical connector, a wide variety of which are familiar to those of skill in the art, e.g., an Edison connector (for insertion in an Edison socket), a GU-24 connector, etc., or may be directly wired to an electrical branch circuit.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.).

Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Energy can be supplied to the at least one light source from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross-sections may be rotated around a central axis to provide lighting devices that are circular in nature. Alternatively, the cross-sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
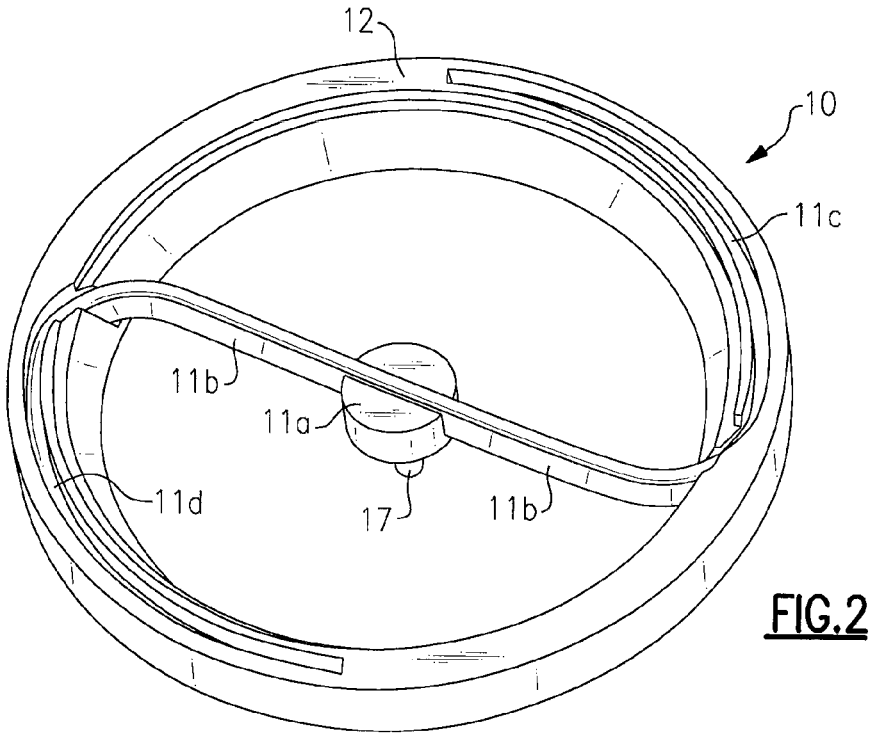
FIG. 2 is a perspective view of the lighting device 10.
Figure 3:
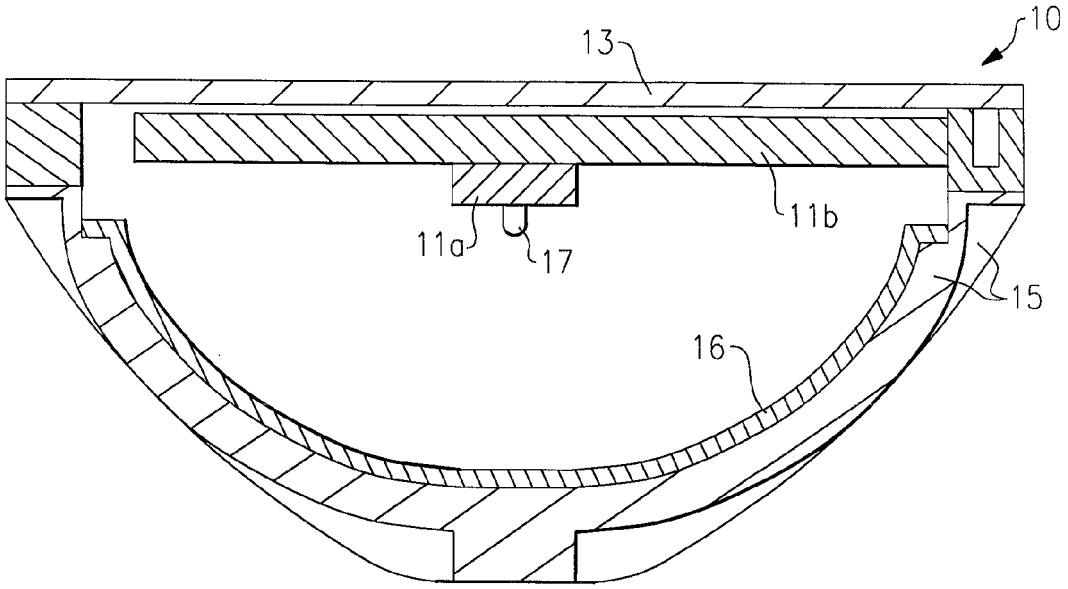
FIG. 3 is a cross-sectional view taken along the plane 3-3 shown in FIG. 1.

FIGS. 1-3 illustrate a first lighting device 10 in accordance with the present inventive subject matter. FIG. 1 is a top view of the lighting device 10. FIG. 2 is a perspective view of the lighting device 10. FIG. 3 is a cross-sectional view taken along the plane 3-3 shown in FIG. 1.

The lighting device 10 comprises a heat dissipation element 11, a rim 12, a lens 13, a housing 15, a reflector 16 and a light source 17.

The heat dissipation element 11 comprises a first portion 11*a* (on which the light source 17 is mounted), a second portion 11*b* that extends across the lighting device and third and fourth portions 11*c* and 11*d* that are in contact with the rim 12. In the illustrated lighting device 10, the first portion is substantially circular and is near the center of the lighting device (as seen in FIG. 1), the second portion is substantially diametrical and the third and fourth portions are partial circumferential (i.e., they define part of a circumference, i.e., a perimeter of any shape), but in other embodiments, the entirety of the heat dissipation element 11 or portions thereof can be positioned and oriented in any suitable way.

The expression "substantially circular" means that a circle can be drawn having the formula $x^2+y^2=1$, where imaginary axes can be drawn at a location where the y coordinate of each point on the structure is within 0.95 to 1.05 times the value obtained by inserting the x coordinate of such point into such formula.

In the lighting device 10, the first and second portions of the heat dissipation element 11 each comprise at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and the third and fourth portions of the heat dissipation element 11 comprise a material with good thermal conductivity (e.g., having a heat conductivity of at least 1 W/m-K), which can be the same material as the first portion and/or the second portion of the heat dissipation element 11 or can be a different material. In some embodiments, the third and fourth portions of the heat dissipation element 11 are at least partially opaque or substantially opaque. Alternatively, any portion or portions of the heat dissipation element 11 can comprise at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and any other portion or portions of the heat dissipation element 11 can comprise any other suitable material.

In the lighting device 10, the third and fourth portions of the heat dissipation element 11 are each in thermal contact with the rim 12, each being snugly fitted in respective grooves in the rim 12, such that each of the third and fourth portions are in contact with the rim 12 on an inside surface, an outside surface and a bottom surface.

The rim 12 is substantially annular, i.e., it is of a shape that comprises at least a portion (namely, the entirety) of a substantially annular shape, and the annular shape is substantially circular.

The third and fourth portions of the heat dissipation element 11 each extend substantially circumferentially along the substantially circular substantially annular shape, i.e., the rim 12, for about 170 degrees around the circumference of the rim 12. The third and fourth portions each extend in the same circumferential direction, i.e., counter-clockwise as seen from above in FIG. 1.

The first portion of the heat dissipation element 11 is in thermal contact with the second portion of the heat dissipation element 11. The first portion of the heat dissipation element 11 comprises a groove, and a portion of the second portion of the heat dissipation element 11 extends along the groove.

The light source 17 can be a light emitting diode (or a plurality of light emitting diodes) or any other suitable light source. The light source 17 can be replaced with any other suitable kind of light source, or with a plurality of any kind of light sources, or with one or more of each of a plurality of different kinds of light sources.

Figure 4:
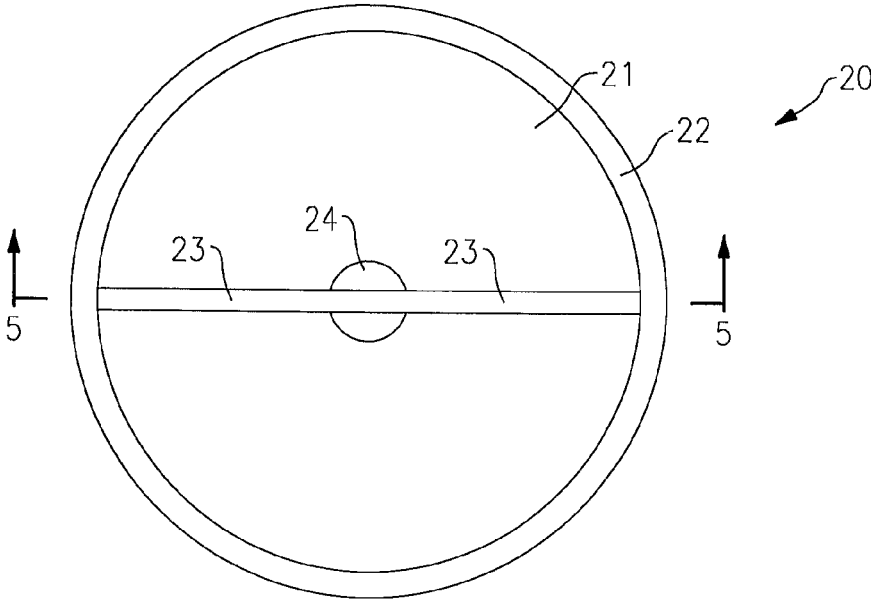
FIG. 4 is a top view of a lighting device 20.
Figure 5:
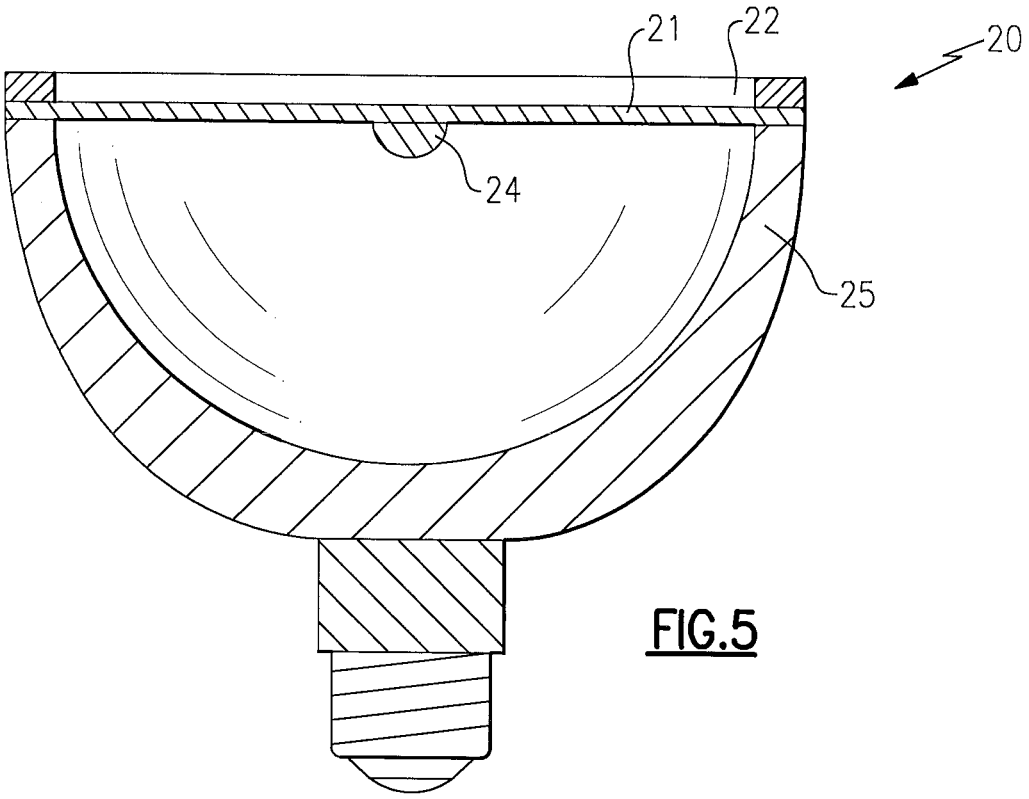
FIG. 5 is a sectional view of the lighting device 20 taken along the plane 5-5 shown in FIG. 4.

FIGS. 4-5 illustrate a second lighting device 20 in accordance with the present inventive subject matter. FIG. 4 is a top view of the lighting device 20. FIG. 5 is a sectional view of the lighting device 20 taken along the plane 5-5.

Referring to FIG. 4, the lighting device 20 comprises a lens 21 which functions as a heat dissipation element, a rim 22, a conductive trace 23, a light source 24, and a housing 25.

The lens 21 covers an aperture defined by the housing 25, and the lens 21 comprises at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum. All of the light emitted by the light source 24 that exits the lighting device passes through the lens 21.

The lens 21 (A) can be entirely made of at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, or (B) respective portions of the lens 21 can be made of different materials (which can each be selected from among (1) sintered silicon carbide, (2) a sintered mixture of silicon carbide and at least one other ceramic material, (3) a sintered mixture of silicon carbide and at least one metal other than aluminum, (4) a sintered mixture of silicon carbide, at least one other ceramic material and at least one metal other than aluminum, and (5) some other material).

Figure 6:
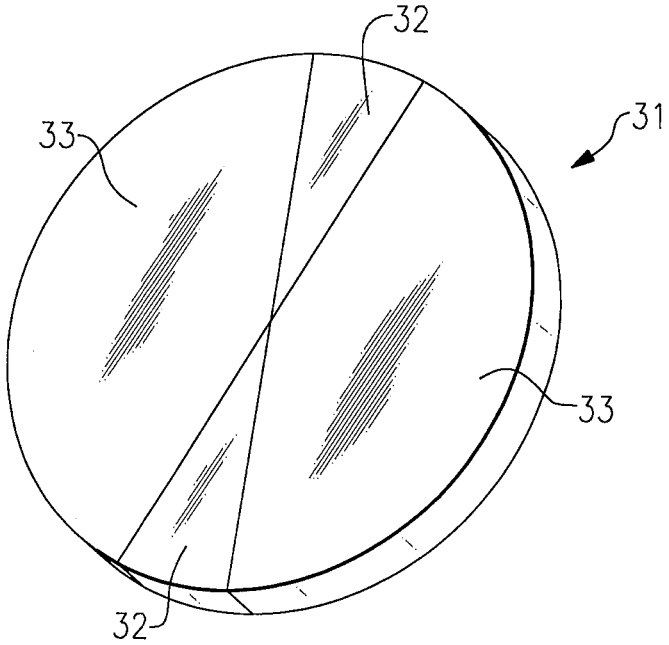
FIG. 6 depicts an alternative lens.

For example, FIG. 6 depicts an alternative lens 31 that includes regions 32 made of at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and regions 33 made of glass (or some other substantially transparent material).

Figure 7:
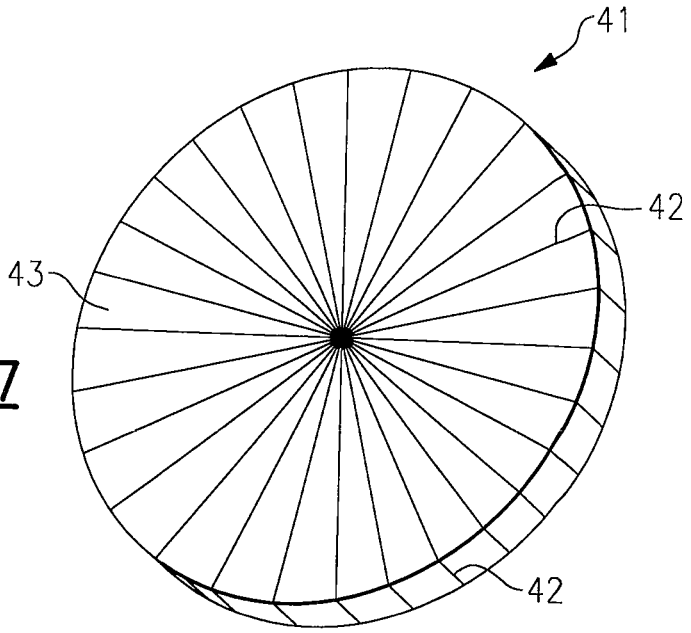
FIG. 7 depicts an alternative lens.

For another example, FIG. 7 depicts an alternative lens 41 that includes slivers 42 made of at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and regions 43 made of glass (or some other substantially transparent material).

Figure 8:
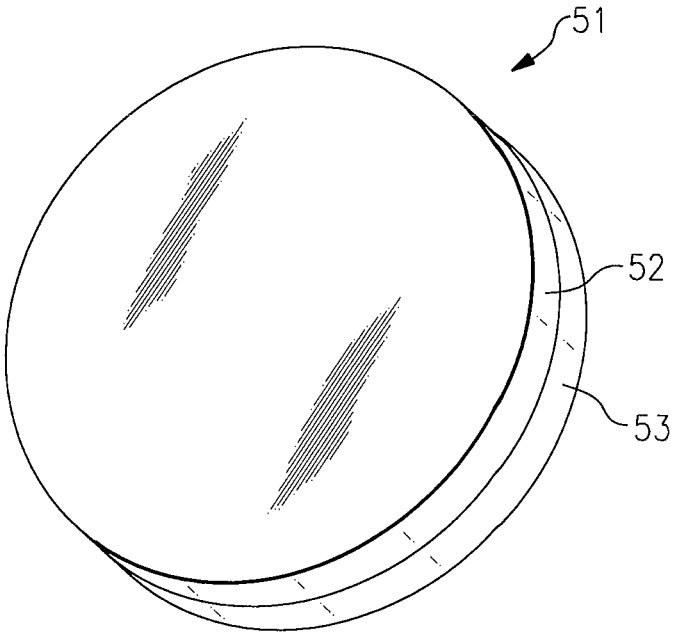
FIG. 8 depicts an alternative lens.

For another example, FIG. 8 depicts an alternative lens 51 that includes a layer 52 made of at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum, and a layer 53 made of glass (or some other substantially transparent material).

Referring again to FIG. 4, the rim 22 extends around a periphery of the lens 21 and can be made of a material of good thermal conductivity (e.g., having a heat conductivity of at least 1 W/m-K). The rim 22 assists in uniformly spreading heat to be dissipated from the housing 25.

The conductive traces 23 provide power to the light source 24. In some embodiments, the conductive traces 23 can be formed of a substantially transparent material or a partially transparent material. Alternatively, rather than being on a top surface of the lens 21, conductive traces 23 can be incorporated in the lens 21 or positioned on the opposite side of the lens 21, and/or power can be supplied to the light source 24 in any other suitable way.

The light source 24 can be a light emitting diode (or a plurality of light emitting diodes) or any other suitable light source. The light source 24 can be replaced with any other suitable kind of light source, or with a plurality of any kind of light sources, or with one or more of each of a plurality of different kinds of light sources.

The housing 25 has a reflective surface facing the light source 24 (and/or a reflective layer can be positioned on the housing 25).

Figure 9:
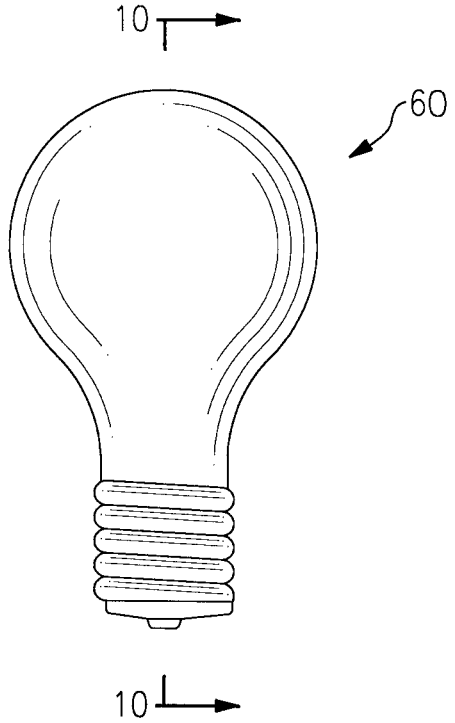
FIG. 9 is a front view of a lighting device 60.
Figure 10:
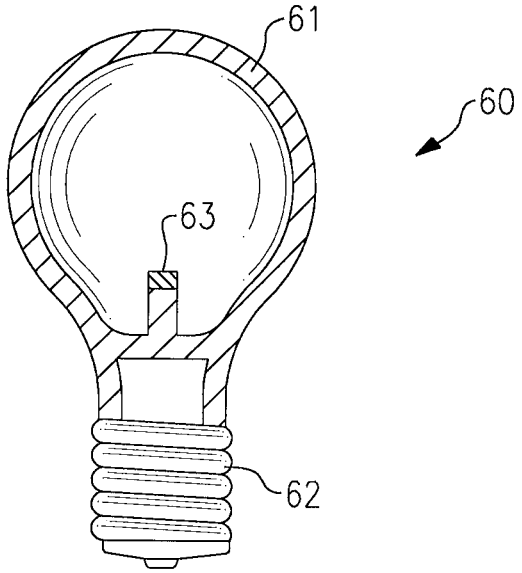
FIG. 10 is a sectional view of the lighting device 60 taken along the plane 10-10.

FIGS. 9-10 illustrate a lighting device 60 in accordance with the present inventive subject matter. FIG. 9 is a front view of the lighting device 60. FIG. 10 is a sectional view of the lighting device 60 taken along the plane 10-10.

Referring to FIG. 10, the lighting device 60 comprises a heat dissipation element 61, an Edison connector 62 and a light source 63.

The heat dissipation element 61 comprises at least one material selected from among (1) sintered silicon carbide, (2) a sintered mixture of silicon carbide and at least one other ceramic material, (3) a sintered mixture of silicon carbide and at least one metal other than aluminum and (4) a sintered mixture of silicon carbide, at least one other ceramic material and at least one metal other than aluminum.

Instead of the Edison connector 62, there can be provided a GU-24 connector, or any other suitable connector, or an element to facilitate mounting the lighting device. Alternatively, in place of the Edison connector 62, the heat dissipation element 61 can be closed (e.g., and house one or more batteries), or be closed around direct wiring to a branch circuit, etc.

The light source 63 can be a light emitting diode (or a plurality of light emitting diodes) or any other suitable light source. The light source 63 can be replaced with any other suitable kind of light source, or with a plurality of any kind of light sources, or with one or more of each of a plurality of different kinds of light sources.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A lighting device comprising:

at least a first light source; and at least a first heat dissipation element, at least a first region of the first heat dissipation element comprising at least one material selected from among (1) a sintered mixture of silicon carbide and at least one other ceramic material, (2) a sintered mixture of silicon carbide and at least one metal other than aluminum, (3) a sintered mixture of silicon carbide, at least one other ceramic material and at least one metal other than aluminum and (4) a sintered mixture of silicon carbide, at least one other ceramic material and at least one metal, the first light source oriented such that at least a portion of light emitted from the first light source is directed toward at least a first portion of the first region of the first heat dissipation element.

2. A lighting device as recited in claim 1, wherein at least a portion of the first heat dissipation element is substantially cylindrical.

3. A lighting device as recited in claim 1, wherein at least a portion of the first heat dissipation element is substantially disc-shaped.

4. A lighting device as recited in claim 1, wherein at least a portion of the first heat dissipation element is substantially bulb-shaped.

5. A lighting device as recited in claim 1, wherein the first light source is in contact with the first heat dissipation element.

6. A lighting device as recited in claim 5, wherein the first light source is in direct contact with the first heat dissipation element.

7. A lighting device as recited in claim 1, wherein at least a first cross-section of the first heat dissipation element is substantially annular.

8. A lighting device as recited in claim 1, wherein the first heat dissipation element comprises at least one opaque region.

9. A lighting device as recited in claim 1, wherein the first heat dissipation element comprises at least a first reflective region.

10. A lighting device as recited in claim 1, wherein the first region of the first heat dissipation element further comprises at least one material selected from among scattering agents and luminescent materials.

11. A lighting device as recited in claim 1, wherein at least a second region of the first heat dissipation element comprises at least one material selected from among diamond, glass, polymer and ceramic.

12. A lighting device as recited in claim 1, wherein the first region of the first heat dissipation element is substantially transparent.

13. A lighting device as recited in claim 1, wherein substantially all light emitted by the first light source that exits the lighting device passes through the first heat dissipation element.

14. A lighting device comprising:

at least a first light source; and at least a first heat dissipation element, at least a first region of the first heat dissipation element comprising at least one material selected from among (1) a sintered mixture of silicon carbide and at least one other ceramic material, (2) a sintered mixture of silicon carbide and at least one metal other than aluminum, (3) a sintered mixture of silicon carbide, at least one other ceramic material and at least one metal other than aluminum and (4) a sintered mixture of silicon carbide, at least one other ceramic material and at least one metal, at least a first portion of the first region of the first heat dissipation element substantially surrounding the first light source.

15. A lighting device as recited in claim 1, wherein substantially all light emitted by the first light source that exits the lighting device passes through the first heat dissipation element.

16. A lighting device as recited in claim 14, wherein the first light source is in contact with the first heat dissipation element.

17. A lighting device as recited in claim 14, wherein the first light source is in direct contact with the first heat dissipation element.

18. A lighting device as recited in claim 14, wherein at least a first region of the first heat dissipation element comprises at least one material selected from among diamond, glass, polymer and ceramic.

19. A lighting device as recited in claim 1, wherein the first light source comprises at least one solid state light emitter.

20. A lighting device as recited in claim 1, wherein the first light source comprises at least one light emitting diode.

21. A lighting device comprising:

at least a first light source;

at least a first heat dissipation element; and at least a first reflector, at least a first region of the first heat dissipation element comprising at least one material selected from among (1) a sintered mixture of silicon carbide and at least one other ceramic material, (2) a sintered mixture of silicon carbide and at least one metal other than aluminum, (3) a sintered mixture of silicon carbide, at least one other ceramic material and at least one metal other than aluminum and (4) a sintered mixture of silicon carbide, at least one other ceramic material and at least one metal, the first light source and at least a first portion of the first region of the first heat dissipation element both to a first side of the first reflector.

22. A lighting device as recited in claim 21, wherein at least a portion of light emitted by the first light source that exits the lighting device passes through the first heat dissipation element.

* * * * *